United States Patent [19]

Treaster

[11] Patent Number: 4,552,121

[45] Date of Patent: Nov. 12, 1985

[54] ARCHERY SIGHTS

[76] Inventor: Mahlon L. Treaster, R.D. 2, Box 288 Cafferty Rd., Harpursville, N.Y. 13787

[21] Appl. No.: 649,947

[22] Filed: Sep. 13, 1984

[51] Int. Cl.[4] ..... F41B 5/00

[52] U.S. Cl. ..... 124/87; 33/265; 124/90

[58] Field of Search ..... 124/23 R, 24 R, 87, 124/88, 90; 33/265

[56] References Cited

U.S. PATENT DOCUMENTS

| | | | |
|---|---|---|---|
| 1,885,962 | 11/1932 | Swenson et al. | 124/23 R |
| 3,859,733 | 1/1975 | Chesnick | 33/265 |
| 4,011,853 | 3/1977 | Fletcher | 124/87 |
| 4,116,194 | 9/1978 | Topel | 124/87 |

*Primary Examiner*—Richard C. Pinkham
*Assistant Examiner*—Benjamin Layno
*Attorney, Agent, or Firm*—Richard G. Stephens

[57] ABSTRACT

An archery back sight is arranged to removably snap onto or slide onto a bowstring, and connected to a cord having an elastic portion and an inelastic portion which aims the backsight forwardly. The cord is positioned in a manner such that breaking of the cord will not endanger the user.

5 Claims, 12 Drawing Figures

ARCHERY SIGHTS

My invention relates to archery sights, and more particularly to an improved bowstring-fitted or "back" sight which an archer may align with a bow-mounted front sight to determine aiming direction. Some prior art relating to back sights which may be of interest is shown in U.S. Pat. Nos. 4,011,853 and 4,116,194.

Various prior art back sights have been required to be mounted on a stranded bowstring by relaxing and untwisting the same until the body of the sight can be inserted. While such operations are not terribly difficult, they can be time consuming, and very difficult to perform in the field. Further, such sights are not usable with unstranded bowstrings, or bowstrings of which strands are difficult or impossible to separate. One object of the present invention is to provide an improved "snap-on" or "slide-on" back sight which may be easily installed and removed from a bowstring. Another object of the invention is to provide an improved back sight which can be used on either stranded bowstrings or non-stranded bowstrings.

In order to keep a back sight aimed forwardly toward the bow even though it is mounted on a flexible bowstring, and thus susceptible to some rotation around the axis of the bowstring, it is known that a resiliently extensible cord can be connected between the back sight and a point on the bow slightly above the front sight. While such a cord can effectively keep the back sight aimed in the desired forward direction when the bowstring is drawn, it tends to create some danager. If the cord breaks or loosens from its attachment to the bow, a length of elastic cord may rapidly strike the user's face or eye, inflicting injury. Another important object of the invention is to provide an arrangement which keeps a back sight properly aimed forwardly when the bowstring is drawn, but which will not endanger the user in case of breakage.

Other objects of the invention will in part be obvious and will in part appear hereinafter.

The invention accordingly comprises the features of construction, combination of elements, and arrangement of parts, which will be exemplified in the constructions hereinafter set forth, and the scope of the invention will be indicated in the claims.

For a fuller understanding of the nature and objects of the invention reference should be hade to the following detailed description taken in connection with the accomanying drawings, in which.

Figure 1:
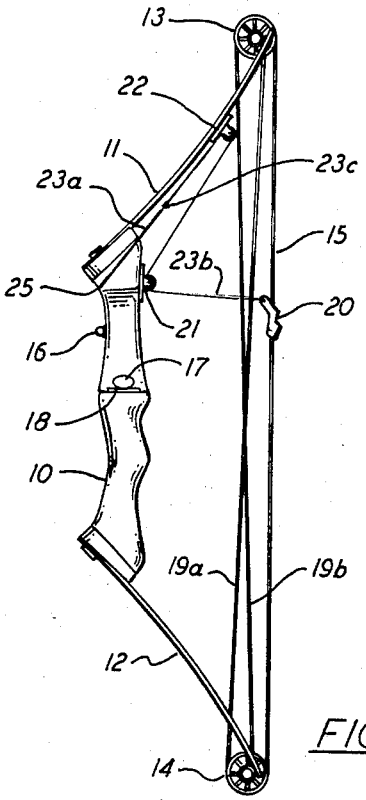
FIG. 1 is a side elevation view showing a known form of bow equipped with the back sight assembly of the invention, with the bow in a relaxed condition.

Referring to FIG. 1, a known form of compound bow comprises an essentially rigid central handle member 10, to which upper and lower leaf spring members 11, 12 are bolted. Pulley 13 is mounted on the upper end of leaf spring 11, and pulley 14 is mounted on the lower end of leaf spring 12. A conventional bowstring 15 is connected to cables at the pulleys to extend between pulleys 13 and 14. Conventional cross cables **19*a*, 19*b* extend between the pulleys. A brush-like arrow-rest pad is shown at 18, and another pad is shown at 17. Handle member 10 also carries a conventional front sight 16**. As thus ar described the bow is completely conventional, and is shown as comprising a commercially-available type sold under the trademark "Cellerator".

Figure 5:
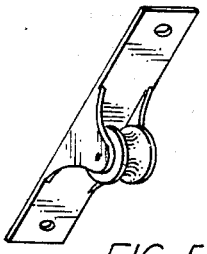
FIG. 5 is a perspective view of a line-guiding means portion of the back sight assembly.

In accordance with the invention, a back sight 20 snaps onto or slides onto bowstring 15, a first line-guiding means 21 is mounted on the rear side of handle member 10 at a level above front sight 16, and a second line-guiding means 22 is mounted on upper leaf spring 11. Each of the line-guiding means preferably comprises a pulley block of the type illustrated in FIG. 5. Flexible cord means having an essentially elastic or resiliently-extensible section **23*a* and an inelastic section 23*b* extend between back sight 20 and handle member 10, passing through line-guiding means 21 and 22. The two sections of cord means 23 join at 23*c*, that junction being shown enlarged for sake of explanation. The other end of elastic section 23*a* is affixed to handle member 10 at 25** by means of a screw or the like.

Figure 4:
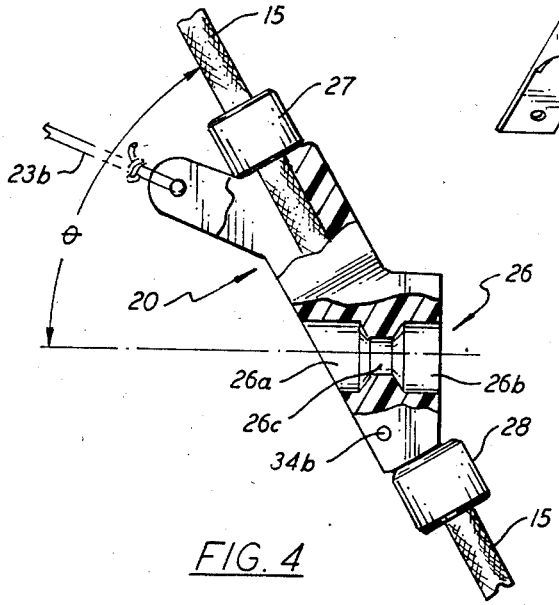
FIG. 4 is a side elevation view, with portions cut away, showing the back sight of FIG. 3 installed on a bowstring.
Figure 3:
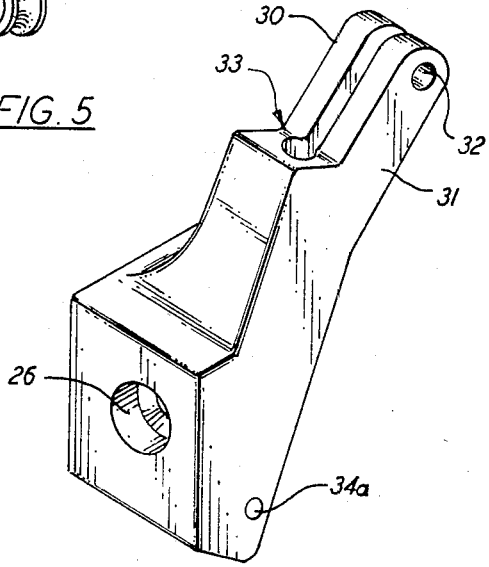
FIG. 3 is a perspective rear view of a preferred form of snap-on back sight.
Figure 6:
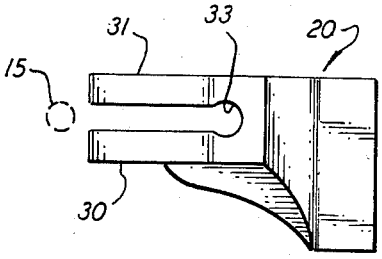
FIG. 6 is a top view of the back sight of FIGS. 3 and 4.
Figure 7:
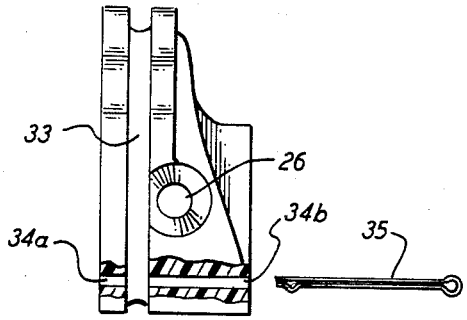
FIG. 7 is a front view of the back sight of FIGS. 3, 4 and 6.
Figure 8:
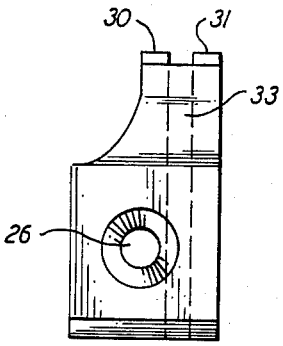
FIG. 8 is a rear view of the back sight of FIGS. 3, 4, 6 and 7.
Figure 9:
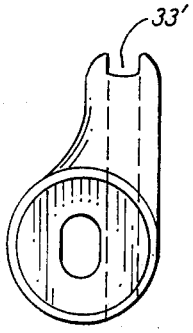
FIG. 9 is a rear view of an alternative form of back sight.
Figure 12:
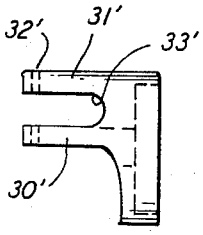
FIG. 12 is a top view of the sight of FIGS. 9–11.
Figure 10:
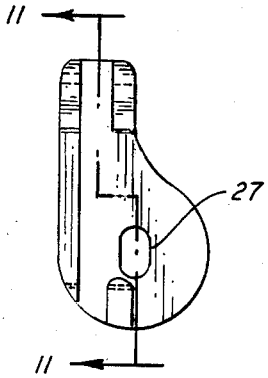
FIG. 10 is a front view of the back sight of FIG. 9.
Figure 11:
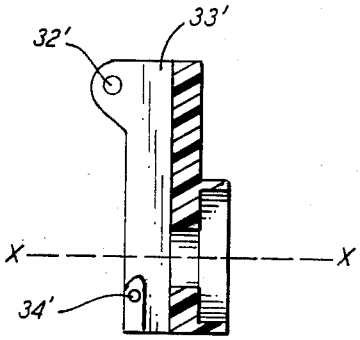
FIG. 11 is a cross-section view taken at lines 11—11 in FIG. 10.

Back sight 20 snaps on or slides on bowstring 15 in between a pair of stop means 27, 28 crimped onto the bowstring, as shown in FIG. 4. The bowstring lies in a slot in back sight 20, as will be described in greater detail, so that when the bowstring is relaxed, back sight 20 can rotate about the axis of the section of bowstring 15 between the two stop means. An end of inelastic cord section **23*b* passes through holes (e.g. 32 in FIG. 3) in a pair of forwardly-extending arm portions 30,31 of back sight 20 and then is knotted to itself, as shown in FIG. 4**.

Figure 2:
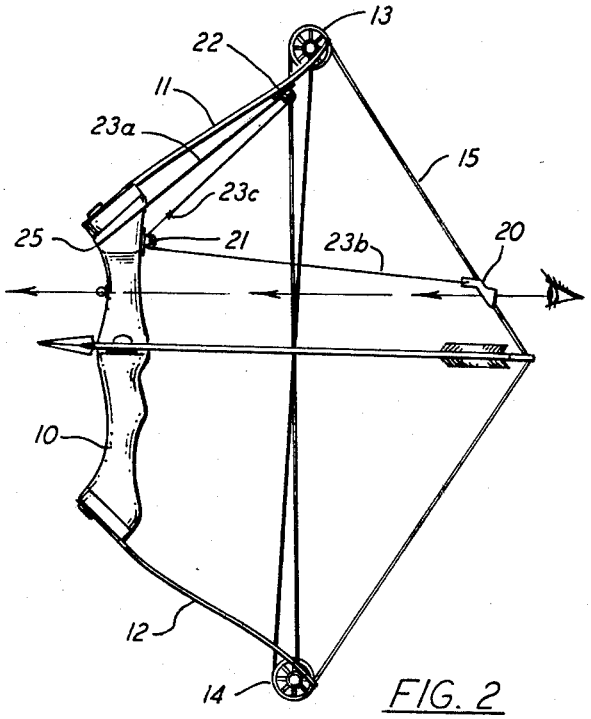
FIG. 2 is a side elevation similar to FIG. 1 but with the bowstring drawn and an arrow in place.

When the bowstring is drawn, as is shown in FIG. 2, the stretching of elastic section **23*a* applies a forward pull to back sight 20 via inelastic section 23*b*, thereby constraining ack sight 20 to rotate to a predetermined angle, so that sighting bore 26 (FIGS. 3,4) in back sight 20 is aimed forwardly, toward front sight 16**. The broad idea of provision of an elastic cord to constrain a back sight to point forwardly is not in itself new. However, in various prior art bow assemblies, the breaking or detachment of such a cord could cause injury t the archer.

By comparison of FIGS. 1 and 2, it will be evident that as the bowstring is drawn, the junction **23*c* between the elastic and inelastic sections of cord means 23 first ridges upwardly and over the pulley of upper line-guiding means 22, and then downwardly toward line-guiding means 21. The respective lengths of the elastic and inelastic sections of cord means 23, and the elasticity of elastic section 23*a* preferably are chosen so that junction 23*c* lies slightly above line-guiding means 21, at a position such as that shown in FIG. 2, when maximum tension has been applied to the bowstring. It is workable to allow the junction 23c to pass around the pulley of lower line-guiding means 21, so that a short portion of the elastic section points from that pulley toward back sight 20 when the bowstring is fully tensioned, but important hat only a short portion of the elastic section pass around the pulley of line-guiding means 21**.

Assuming that junction 23c lies near the position shown in FIG. 2, it can be seen that if elastic section 23a detaches from its tie point at 25, or detaches from inelastic section 23b at junction 23c, or if elastic section 23a breaks anywhere along its length, that portion of the elastic section will rapidly travel in one direction or the other along the line between tie point 25 and upper line-guiding means 22, or rapidly travel in one direction or the other along the line between lower line-guiding means 21 and upper line-guiding means 22, depending in each case on where the breaking or detachment occurs. Similarly, if inelastic section 23b breaks anywhere along its length or becomes detached from back sight 20, the elastic section will move only between the two mentioned lines. Importantly, and irrespective of where breakage or detachment occurs, no cord portion will be flung rearwardly toward the user's face. Because section 23b is inelastic, breakage or detachment will not result in appreciable rearward motion of any portion of inelastic cord portion 23b, and instead any portion of that section left attached to back sight 20 will merely become limp, i.e. experience no tension. Inelastic cord section 23b may comprise, for example, a length of cotton twine, or a length of nylon line. Elastic section 23a is preferably formed of rubber, and it may comprise either a single length or an endless loop, i.e. a rubber band.

As shown in FIGS. 3, 4 and 6–8, one form of back sight may comprise an integral member preferably molded from plastic. In the top view shown in FIG. 6, a bowstring is also shown in dashed lines at 15. To install the back sight on the bowstring, the back sight 20 is moved from a position rearward of the bowstring, in a forward direction (leftwardly in FIG. 6). The distance between arms 30,31 is less than the uncompressed diameter of the bowstring, so that the bowstring is somewhat compressed, and arms 30,31 are slightly spread apart, as the bowstring moves between arms 30,31, until the bowstring reaches slot 33, which has a width greater than the distance between arms 30,31, whereupon arms 30,31 move toward each other to their normal relaxed positions, and the bowstring lies trapped in slot 33. The sight may be removed from the bowstring by exerting enough rearward force on the sight to spread arms 30,31. While the location along a bowstring where a conventional back sight is to be installed is not covered, since the strands must be unwrapped to install such a back sight, the length of bowstring between stops 27,28 (FIG. 4) is peferably coated or wrapped, in the manner in which finger and arrow-nock areas along conventinal bowstrings are coated or wrapped.

As the archer releases the bowstring, the sight moves forwardly with the bowstring. The clamping force of arms 30,31 is preferably made sufficiently great that the forward rush of the bowstring does not pull it out of slot 33 and from between arms 30,31, and that is easily accomplished, since the sight has very little weight. If desired, to insure that the sight 20 cannot fall off the bowstring when the latter is released, a pair of bores 34a, 34b (FIGS. 3,4, and 7) may be provided through the base of the back sight, forwardly from slot 33. A string (not shown) or a pin (not shown), or preferably a metal wire spring clip of the type shown at 35 in FIG. 7, may be extended through bores 34a, 34b when the bowstring lies in slot 33, thereby locking the bowstring in slot 33.

As is best evident in FIG. 4, an acute angle $\theta$ exists between the direction at w hich the bowstring passes through the back sight, and the sighting axis of sighting bore 26. When the bowstring is relaxed and extending substantially vertically, as shown in FIG. 1, the sighting axis points substantially upwardly, but when the bowstring is drawn, as shown in FIG. 2, so that the portion of the bowstring on which the sight is mounted extends substantially non-vertically, the sighting axis points substantially horizontally. As seen in FIG. 4, the sighting bore 26 preferably comprises forward and rearward cylindrical bores 26a, 26b, and a smaller cylindrical central bore 26c.

In the alternative form of back sight illustrated in FIGS. 9–12 parts serving functions similar to those of FIGS. 3, 4 and 6–8 are given similar reference designations. The sighting axis X—X (FIG. 11) extends perpendicularly to the slot 33' in which the bowstring lies. Hence when the bowstring is relaxed, the sighting axis extends substantially horizontally. A forward sighting bore 27 (FIG. 10) comprises a vertically enlarged hole. When the bowstring is drawn, the sighting axis points substantially downwardly, but a view generally horizontally through the then tilted enlarged hole presents a circular appearing field of view. In the device of FIGS. 9–12, the space between arms 30',31' does not differ appreciably from the width of slot 33' into which the bowstring fits, and hence the sight of FIGS. 9–12 does not snap onto the bowstring, but instead slides easily onto the bowstring. With such an arrangement, it is necessary, of course, rather than being optional, to provide means to lock the sight onto the bowstring, and to that end bores (such as tthat at 34') are provided in front of the slot 33' where the bowstring seats, so that a string or pin may be extended through the bores to lock the sight onto the bowstring. It will be understood that the back sight of FIGS. 9–12 is installed in an assembly of the nature shown in FIGS. 1 and 2. Whether the back sight is arranged to snap onto the bowstring or instead slide onto the bowstring is not related to whether the sighting axis is perpendicular to the slot in which the bowstring seats. The space between arms 30,31 in the device of FIGS. 3,4 and 6–8 may be widened so that device will slide onto the bowstring, and the space between arms 30',31' of the device of FIGS. 9–12 may be narrowed so that the device snaps onto the bowstring. The sighting bore 26 of the device of FIGS. 3,4 and 6–8 may be arranged to extend perpendicularly to slot 33 in which the bowstring lies, and the bores 26a–26c vertically enlarged. While the invention has been illustrated in connection with a compound bow, it should be apparent that its use is by no means limited to copound bows, nor is its use limited to bows having a rigid central control section and an upper leaf spring.

It will thus be seen that the objects set forth above, among those made aparent from the preceding description, are efficiently attained, and since certain changes may be made in the above constructions without departing from the scope of the invention, it is intended that all matter contained in the above description or shown in the accompanying drawings shall be interpreted as illustrative and not in a limiting sense.

The embodiments of the invention in which an exclusive property or privilege is claimed are defined as follows:

1. In archery apparatus having a bow carrying a front sight, a bowstring, and a back sight carried on said bowstring, the combination of cord means extending between said bow and said back sight, said cord means comprising a resiliently extensible section attached to said bow and an inelastic section attached to said back sight; and line-guiding means for training said resiliently extensible section to lie in a direction angularly displaced from a line between said front sight and back sight when said bowstring is drawn, so that breaking or detachment of any portion of said cord means causes each portion of said resiliently extensible section to move in a direction displaced from said line.

2. The apparatus of claim 1 wherein said line-guiding means comprises a first pulley means mounted on said bow above the level of said front sight, and second pulley means mounted on said bow above the level of said first pulley means.

3. The apparatus of claim 1 wherein said back sight comprises a member having a slot adapted to seat a portion of said bowstring, a sighting bore extending through said member, and means for retaining said member on said bowstring.

4. The apparatus of claim 3 wherein said means for retaining said member on said bowstring comprises a pair of arm members spaced apart at a distance less than the width of said slot and resiliently spreadable apart to allow said bowstring to be forced between said arm members into said slot.

5. The apparatus of claim 3 wherein said means for retaining said member on said bowstring comprises a pair of bores situated in said member forwardly from said slot and through which a retaining means may be inserted to lock said member on said bowstring.

* * * * *